US007438064B2

(12) United States Patent
Borchardt et al.

(10) Patent No.: US 7,438,064 B2
(45) Date of Patent: Oct. 21, 2008

(54) MIXTURE-LUBRICATED INTERNAL COMBUSTION ENGINE

(75) Inventors: Jan Borchardt, Waiblingen (DE); Kai-Ulrich Machens, Stuttgart (DE); Rainer Ziegler, Remseck (DE); Robert Wirtz, Euskirchen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 11/505,425

(22) Filed: Aug. 17, 2006

(65) Prior Publication Data

US 2007/0039574 A1 Feb. 22, 2007

(30) Foreign Application Priority Data

Aug. 19, 2005 (DE) ..... 10 2005 039 315

(51) Int. Cl.
*F01M 1/04* (2006.01)
*F01M 3/00* (2006.01)
*F02B 25/00* (2006.01)

(52) U.S. Cl. ..... 123/572; 123/196 CP; 123/196 R

(58) Field of Classification Search ..... 123/196 R, 123/196 M, 196 CP, 90.33, 572, 65 VD, 65 WV, 123/65 R, 317
See application file for complete search history.

(56) References Cited

U.S. PATENT DOCUMENTS 3,839,996 A * 10/1974 DeBiasse ..... 123/572
5,582,145 A * 12/1996 Aizawa et al. ..... 123/196 CP
5,709,185 A * 1/1998 Aizawa et al. ..... 123/196 R
6,199,532 B1 3/2001 Häberlein et al.
6,431,157 B1 * 8/2002 Marcil ..... 123/568.11
6,877,474 B2 * 4/2005 Radel ..... 123/196 R

* cited by examiner

*Primary Examiner*—Stephen K. Cronin
*Assistant Examiner*—Ka Chun Leung
(74) *Attorney, Agent, or Firm*—Walter Ottesen

(57) ABSTRACT

A mixture-lubricated internal combustion engine has a cylinder (2) in which a combustion chamber (3) is formed. The combustion chamber (3) is delimited by a piston (5) mounted to move back and forth. The piston (5) drives a crankshaft (7) rotatably journalled in a crankcase (4). The engine has an inlet channel (9) which supplies fuel and combustion air into the combustion chamber (3) as well as an exhaust outlet (13) from which exhaust gases flow from the combustion chamber. The intake inlet (11) and the exhaust outlet (13) are valve controlled. A flow connection is present between the crankcase (4) and the inlet channel (9). A good idle stability and a good idle acoustic of the engine are achieved in that at least one control valve (23, 33, 43, 63) is mounted in the flow connection.

17 Claims, 7 Drawing Sheets

MIXTURE-LUBRICATED INTERNAL COMBUSTION ENGINE

CROSS REFERENCE TO RELATED APPLICATION

This application claims priority of German patent application no. 10 2005 039 315.2, filed Aug. 19, 2005, the entire content of which is incorporated herein by reference.

FIELD OF THE INVENTION

The invention relates to a mixture-lubricated internal combustion engine and especially such an engine in a portable handheld work apparatus such as a motor-driven chain saw, cutoff machine or the like.

BACKGROUND OF THE INVENTION

U.S. Pat. No. 6,199,532 discloses an internal combustion engine wherein a flow connection is provided between the inlet channel and the crankcase. It has been shown that the flow connection has a large influence on the charge cycle in the combustion chamber. Especially during idle, the running performance of the engine is so affected that the idle stability of the engine is reduced.

It has furthermore been shown that a better engine acoustic is achieved during idle in separately lubricated engines than in mixture-lubricated engines.

SUMMARY OF THE INVENTION

It is an object of the invention to provide a mixture-lubricated internal combustion engine of the kind referred to above which has a high idle stability and an improved engine acoustic during idle.

The mixture-lubricated internal combustion engine of the invention includes: a cylinder defining a combustion chamber; a piston disposed in the cylinder so as to move back and forth therein and to delimit the combustion chamber; a crankcase connected to the cylinder; a crankshaft rotatably journalled in the crankcase and driven by the piston; the cylinder having an intake inlet communicating with the combustion chamber; an inlet channel for supplying fuel and combustion air to the intake inlet; the cylinder having an exhaust outlet through which exhaust gases pass from the combustion chamber; a valve system for controlling the opening and closing of the intake inlet and the exhaust outlet; a flow connection between the crankcase and the inlet channel; and, a control valve disposed in the flow connection.

It has been shown that the idle stability can be considerably improved by arranging a control valve in the flow connection between the inlet channel and the crankcase. At the same time, it is possible to improve the engine acoustic especially during idle and to adapt the same to the engine acoustic of a separately lubricated internal combustion engine. The flow connection between inlet channel and crankcase effects a lubrication of the crankcase because of the pulsations in the crankcase and in the inlet channel. These pulsations disturb the inflow of the fresh mixture into the combustion chamber when the inlet valve is open. For an opened inlet valve, the flow cross section of the flow connection can be greatly reduced via the control valve or the flow connection can be completely interrupted. In this way, the influence of the pulsations from the crankcase on the in-flowing fresh mixture is reduced.

In the open position, the control valve has a maximum opening cross section and, in the closed position, the control valve closes the flow connection up to a residual cross section. Accordingly, the flow connection between the crankcase and the inlet channel is not completely interrupted even in the closed position of the control valve. In this way, the underpressure, which is built up in the crankcase during idle, is partially reduced via the residual cross section. The residual cross section amounts especially to approximately 3% to 50%, preferably, 5% to 30% of the maximum cross section. For this design of the residual cross section referred to the maximum opening cross section, the influence of the flow connection on the charge cycle is minimized and, at the same time, an underpressure in the crankcase which is too strong is prevented.

The control valve is advantageously controlled in dependence upon the engine load. Here, it is especially provided that the control valve is substantially closed at low engine load and is opened at high engine load. For low engine load, only a little lubrication of the crankcase is necessary. Because of the substantially closed or completely closed control valve, the influence of the fluctuating crankcase pressure on the charge cycle at low rpms, especially at idle, is minimized so that a good idle stability and a good idle acoustic of the internal combustion engine results.

At full load, an adequate supply of the crankcase with lubricant must be assured. At the same time, the pressure fluctuations are lower at high engine load because of the higher throughput so that no material influence on the running stability results. A throttle element is mounted in the inlet channel and the position of the throttle element is controlled by a throttle shaft. Advantageously, the control valve is configured on the throttle shaft. In this way, a simple configuration of the control valve results and a direct coupling of the valve position to the engine load is provided. A simple configuration results when the throttle shaft has a control section having a transverse slot which defines the control valve.

Advantageously, the control valve is actuated in dependence upon the rpm. A substantial or complete closure of the flow connection is provided at low rpm and a complete opening of the control valve is provided at high rpms. Advantageously, the internal combustion engine has at least one centrifugal weight and an opening controlled by the centrifugal weight with this opening defining the control valve. In this way, a simple control is achieved in dependence upon the rpm. The centrifugal weight is especially supported in a base body rotatably driven by the crankshaft. The controlled opening is formed in the base body. In this way, the opening and the centrifugal weight are well positioned to each other. Especially, the base body is a cam wheel driven by the crankshaft.

Advantageously, the control valve is actuated in dependence upon the underpressure in the crankcase. For low rpms, the crankcase underpressure is high; while, at high rpms, a low underpressure adjusts. Accordingly, the crankcase underpressure changes in dependence upon rpm so that an rpm-dependent control of the control valve can be achieved via the crankcase underpressure in a simple manner. The control valve advantageously has a piston which controls a connecting opening of the flow connection and this piston is charged by the crankcase pressure on one end and by the ambient pressure on the opposite-lying end. The spring is preferably mounted on the end charged with the crankcase pressure and presses the piston especially in the direction toward the end charged by the ambient pressure. The position of the piston is therefore dependent upon the pressure difference between the ambient and the crankcase and can be utilized for controlling the flow connection. The desired opening cross sections can be adapted in a simple manner via the design of the spring.

The control valve is actuated in dependence upon the crankshaft angle of the crankshaft. The inlet and outlet valves of the engine are actuated via rocker levers. The position of the control valve is coupled to the stroke movement of a rocker lever. In this way, there results a simple configuration of the control valve. The control valve is especially coupled to the position of the rocker lever which actuates the inlet valve. With the coupling to the rocker lever, the control valve is actuated with each valve stroke of the inlet valve into the combustion chamber. In this way, it can be ensured in a simple manner that the flow connection between the inlet channel and the crankcase is completely or substantially closed when the inlet valve is open. A simple configuration results when the rocker levers are arranged in a rocker lever housing and the inlet channel is connected to the crankcase via a lubricant bore. The lubricant bore connects the rocker lever housing to the inlet channel. Advantageously, the control valve includes a pin which coacts with the lubricant bore.

Especially, the flow connection between the crankcase and the inlet channel, in which the control valve is mounted, is the only flow connection between crankcase and inlet channel.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
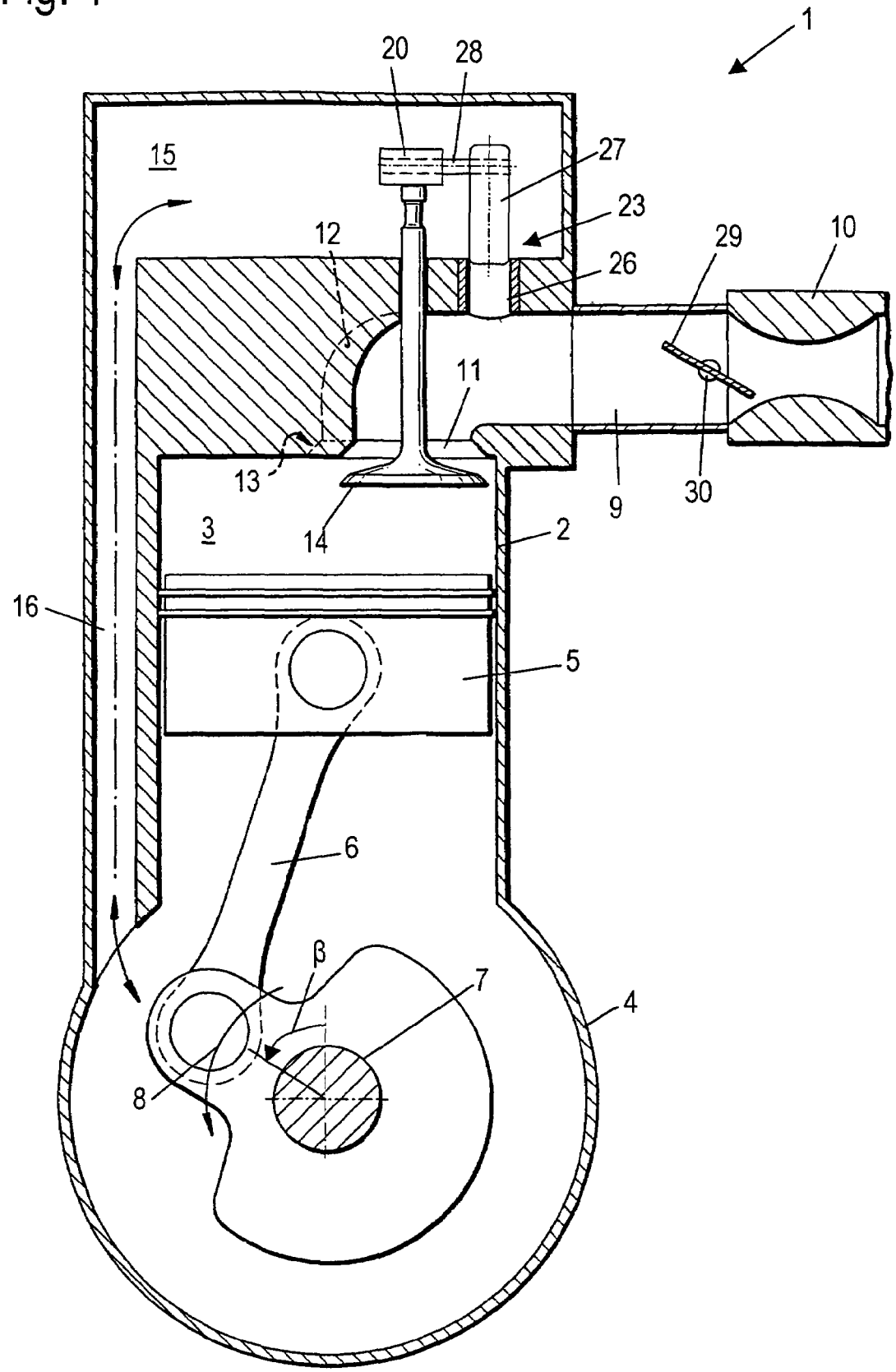
FIG. 1 is a schematic section view through an internal combustion engine.

The internal combustion engine shown in FIG. 1 is configured as a single cylinder four-stroke engine, especially, for a portable handheld work apparatus such as a motor-driven chain saw, cutoff machine or the like. The internal combustion engine 1 has a cylinder 2 wherein a combustion chamber 3 is formed. An inlet channel 9 opens into the combustion chamber 3 via an inlet 11. A carburetor 10 is mounted in the inlet channel 9 and this carburetor supplies fuel to the inducted combustion air. A throttle element, namely, a throttle flap 29 is pivotally journalled in the inlet channel by a throttle shaft 30. In lieu of the carburetor 10, also other mixture preparation units can be used, for example, an injection nozzle or the like. In lieu of the throttle flap 29, also other throttle elements can be provided. The inlet 11 is controlled by an inlet valve 14. A corresponding valve (not shown in FIG. 1) is provided for an outlet 13 from the combustion chamber 3. The exhaust gases flow out of the combustion chamber 3 through the outlet 13 into the discharge channel 12.

The combustion chamber 3 is delimited by a piston 5 arranged in the cylinder 2 for up and down movement. The piston 5 drives a crankshaft 7 in the rotational direction 8 via a connecting rod 6. The crankshaft 7 is rotatably journalled in the crankcase 4. A position of the piston 5 is assigned to each crankshaft angle β of the crankshaft 7.

A valve drive (not shown in detail in FIG. 2) is provided for actuating the inlet valve 14 and the outlet valve. A pinion 22 is mounted on the crankshaft 7 so as to rotate therewith. The pinion 22 drives a cam wheel 73 which is rotatably journalled in a cam housing 17. The pinion 22 and the cam wheel 73 are so designed that the cam wheel 73 executes a full revolution for two revolutions of the crankshaft 7. A control cam 24 is fixedly mounted on the cam wheel 73 and this control cam is driven in rotation with the cam wheel 73. The control cam 24 acts on two control levers 25. One of the control levers 25 operates on a push rod 18 which actuates a rocker lever 20. The rocker lever 20 actuates the inlet valve 14. The other control lever 25 acts via a push rod 19 on a rocker lever 21 which controls the outlet valve (not shown).

The rocker levers 20 and 21 are mounted in a rocker lever housing 15 which is mounted on the end of the cylinder 2 lying opposite the crankcase 4. The two push rods 18 and 19 are guided in channels 16 which run approximately parallel to the stroke direction of the piston 5 and connect the cam housing 17 to the rocker lever housing 15. The cam housing 17 is operatively connected to the crankcase 4 via a connecting opening (not shown in FIG. 2). The flow connection between crankcase 4 and rocker lever housing 15 via the channels 16 is schematically shown in FIG. 1.

As shown in FIG. 1, the rocker lever housing 15 is connected to the inlet channel 9 via a lubricant bore 26. Accordingly, a flow connection is present between the inlet channel 9 and the crankcase 4 via the lubricant bore 26, the rocker lever housing 15, the channels 16, the cam housing 17 and the connecting opening between the cam housing 17 and the crankcase 4. A control valve 23 is configured on the lubricant bore 26. The control valve 23 has a pin 27, especially a snug-fitting pin, which is connected to the rocker lever 20 of the inlet valve 14 via a connecting pin 28. The pin 27 projects, in the open position of the inlet valve 14, into the lubricant bore 26 and closes the same. It can, however, also be provided that the pin 27 does not completely close the lubricant bore 26 but instead, leaves a residual cross section free. This can, for example, be realized by a cutout on the pin 27.

During operation of the internal combustion engine 1, the inlet valve 14 is opened in the region of top dead center of the piston 5 (that is, at a crankshaft angle β of 0°), and an air/fuel mixture is drawn by suction from the inlet channel 9 via the inlet 11 into the combustion chamber 3. With the inlet valve 14 open, the lubricant bore 26 is completely closed or substantially closed by the pin 27. In the region of bottom dead center of piston 5 (that is, when there is a crankshaft angle β of approximately 180°), the inlet valve 14 closes and the pin 27 opens the lubricant bore 26.

During the upward stroke of the piston 5 (that is, for a crankshaft angle β between 180° and 360°), the air/fuel mixture in the combustion chamber 3 is compressed and is ignited by a spark plug (not shown in FIG. 1) in the region of top dead center of piston 5 (that is, at a crankshaft angle β of approximately 360°). The piston 5 is accelerated because of the combustion. In the region of the next following bottom dead center of the piston 5, the outlet valve opens the discharge 13 and the piston 5 presses the exhaust gases out of the combustion chamber 3 into the discharge channel 12.

Figure 2:
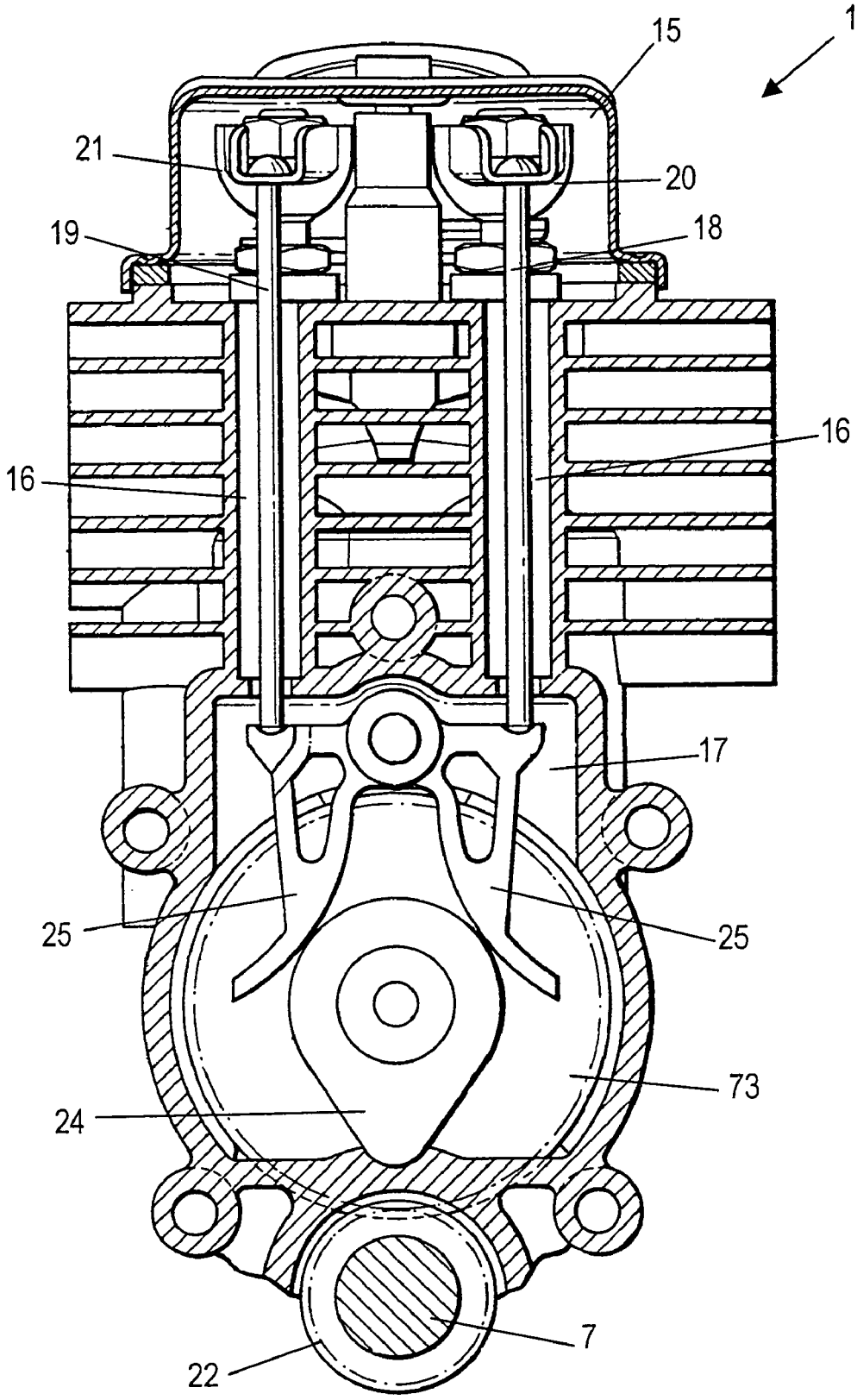
FIG. 2 is a section view of the internal combustion engine of FIG. 1.

The back and forth movement of the piston 5 leads to pressure fluctuations in the crankcase 4. Because of the pressure pulsations, fuel is drawn out of the inlet channel 9 into the crankcase 4 via the flow connection between the inlet channel 9 and the crankcase 4. The total valve drive and the crankshaft 7 are lubricated. Because the lubricant bore 26 is substantially closed when the inlet valve 14 is open, the pressure pulsations do not operate on the intake of fresh mixture into the combustion chamber 3. In this way, an improved idle stability and an improved engine acoustic of the internal combustion engine 1 results. In the embodiment of FIGS. 1 and 2, the control valve 23 is opened and closed in dependence upon the actuation of the inlet valve 14, that is, in dependence upon the crankshaft angle β. In this way, an actuation of the control valve 23 takes place independently of rpm with each second revolution of the crankshaft.

Figure 3:
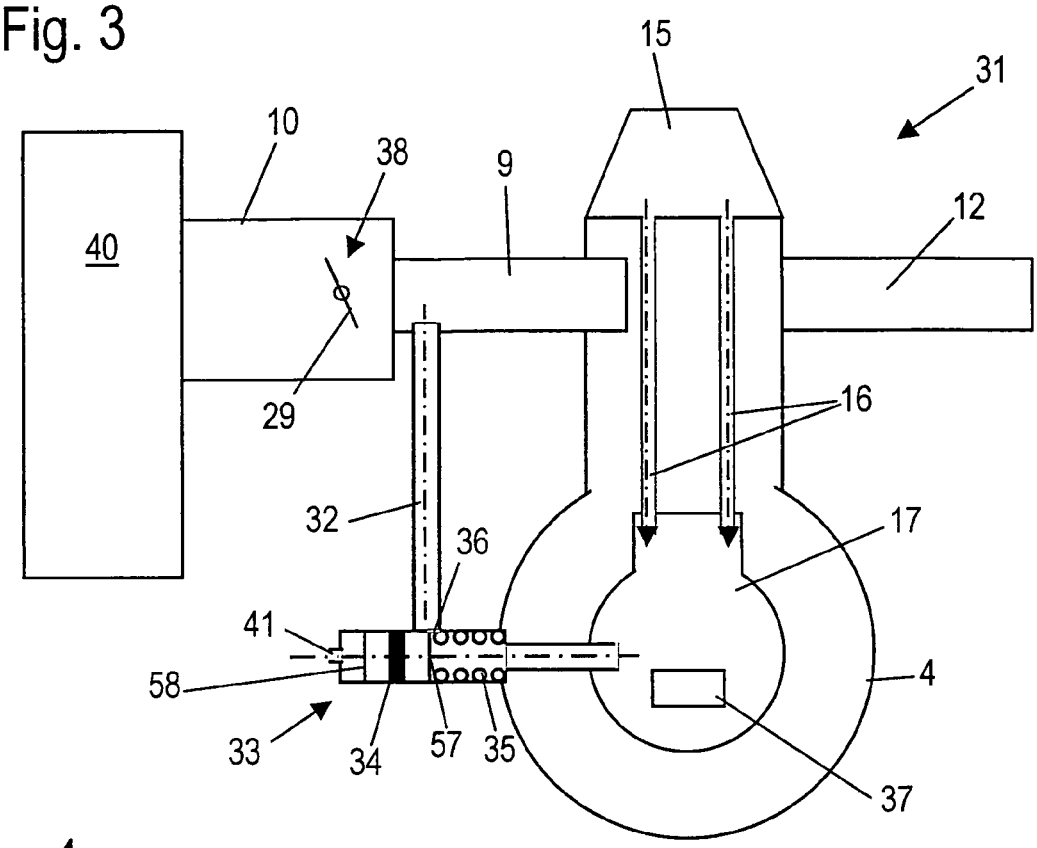
FIG. 3 is a schematic representation of an internal combustion engine having a control valve in a first valve position.
Figure 4:
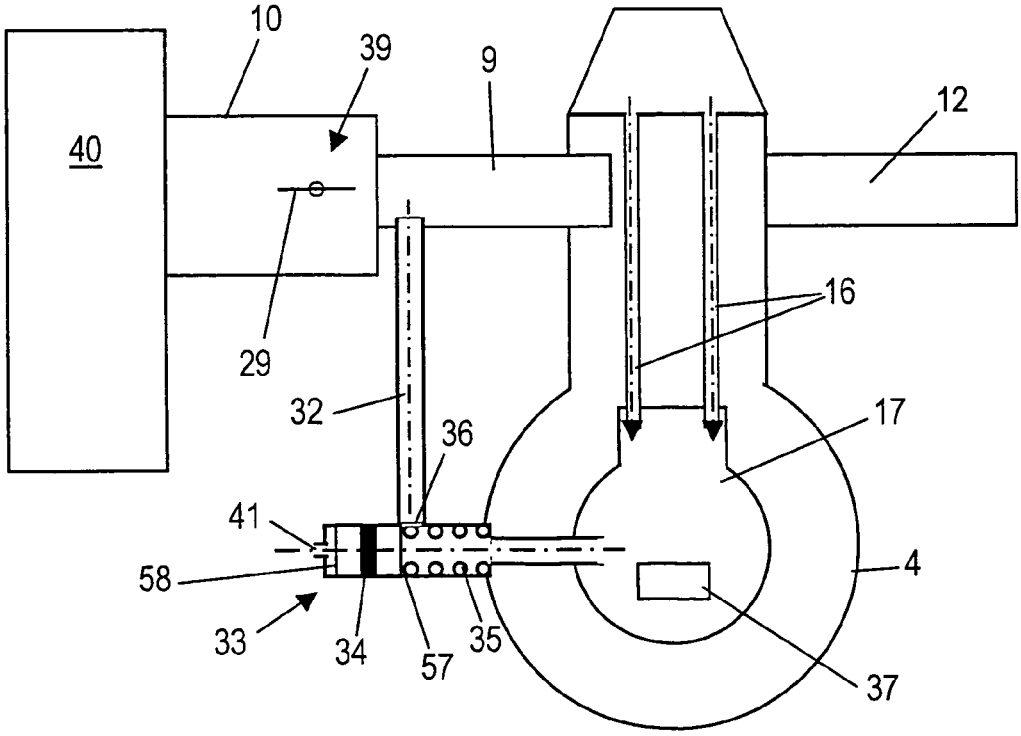
FIG. 4 is a schematic representation of the internal combustion engine of FIG. 3 with the control valve in a second valve position.
Figure 5:
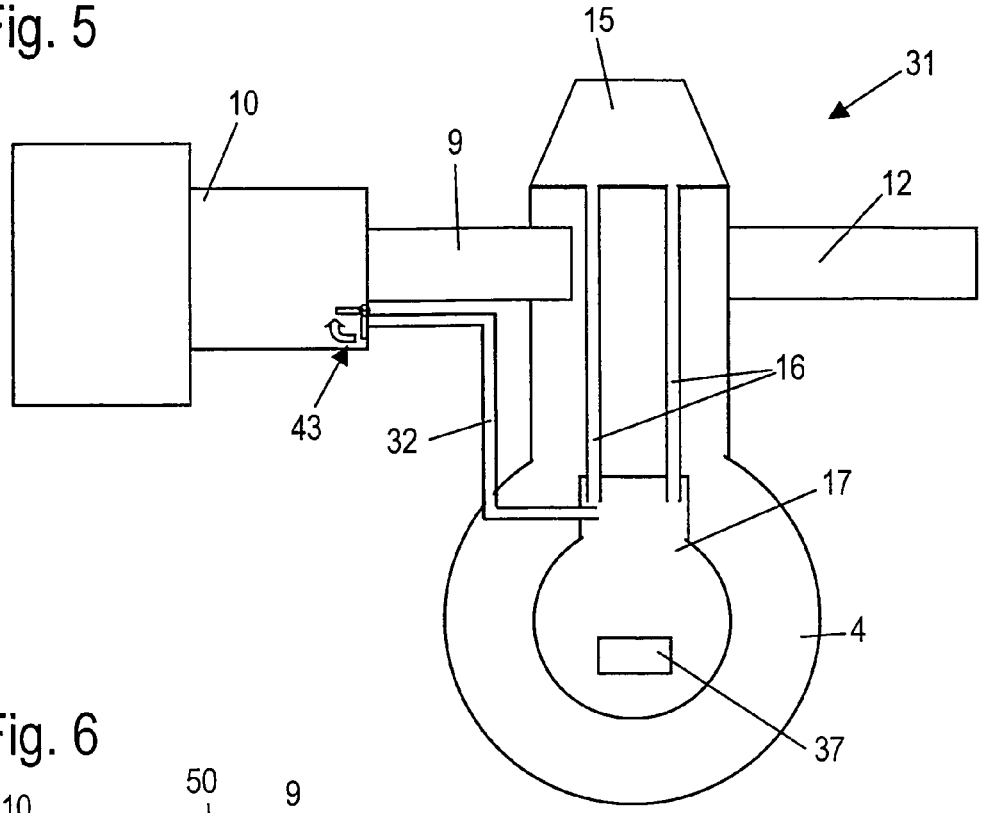
FIG. 5 is a schematic representation of an internal combustion engine.

In FIGS. 3 and 4, an embodiment of an internal combustion engine 31 is shown which is likewise configured as a single cylinder four-stroke engine. The basic configuration of the engine 31 corresponds essentially to the engine 1 shown in FIGS. 1 and 2. The same elements therefore are identified by the same reference numerals. In the internal combustion engine 31, the inlet channel 9 is connected to the cam housing 17 via a connecting channel 32. The rocker lever housing 15 is not connected directly to the inlet channel 9. The inlet channel 9 accordingly communicates via the connecting channel 32 with the cam housing 17 and the cam housing 17 communicates with the rocker lever housing 15 via the two channels 16. The cam housing 17 furthermore has a connecting opening 37 to the crankcase 4.

A control valve 33 is mounted in the connecting channel 32. The control valve 33 has a piston 34 which controls a control opening 36. The piston 34 is charged with the crankcase pressure at an end 57. For this purpose, the connecting channel 32 opens into the cam housing 17 which is connected to the crankcase 4 via the connecting opening 37. The connecting channel 32 can, however, also open directly into the crankcase 4. The opposite-lying end 58 of the piston 34 is connected to the ambient via a venting opening 41. Furthermore, a pressure spring 35 acts on the piston 34 and this pressure spring acts on the end 57 of the piston 34 with this end of the piston being charged by the crankcase pressure. Accordingly, the ambient pressure acts on the piston 34 at the end 58 and the underpressure of the crankcase and the force of the spring 35 act at the end 57.

In FIG. 3, the engine 31 is shown in idle state. The inlet channel 9 inducts combustion air from the ambient via the carburetor 10 and an air filter 40 mounted upstream of the carburetor 10. In the carburetor 10, the throttle flap 29 is mounted which substantially closes the inlet channel 9 in its idle position 38 shown in FIG. 3. During idle, a high underpressure builds up in the crankcase 4. In this way, the piston 34 is pulled against the force of the spring 35 at its end 57 which is charged with the crankcase underpressure. The piston 34 substantially closes the control opening 36 so that only a slight residual cross section remains via which the inlet channel 9 is connected to the crankcase 4.

In the full load position 39 of the throttle flap 29 shown in FIG. 4, the pressure in the crankcase 4 is clearly increased compared to the idle position 38 in FIG. 3. In this way, the piston 34 is pressed, relative to its position in FIG. 3, by the spring force in the direction toward its end 58 charged with ambient pressure. The piston 34 substantially clears the control opening 36. The control valve 33 has a maximum opening cross section in this open position. The inlet channel 9 is connected to the crankcase 4 via a large opening cross section so that an adequate lubrication of the crankcase 4 is ensured.

The underpressure-dependent control of the control valve 33 is shown in FIGS. 3 and 4. In this control of the control valve 33, the valve position is independent of crankshaft angle. For a small load, the control valve 33 is substantially closed and, for large loads, the control valve 33 is completely open.

A further embodiment is shown in FIGS. 5 to 8. The internal combustion engine 31 shown schematically in FIG. 5 corresponds to the internal combustion engine of FIGS. 3 and 4. In lieu of the control valve 33, a control valve 43 is provided on the connecting channel 32 and is mounted on the carburetor 10.

Figure 6:
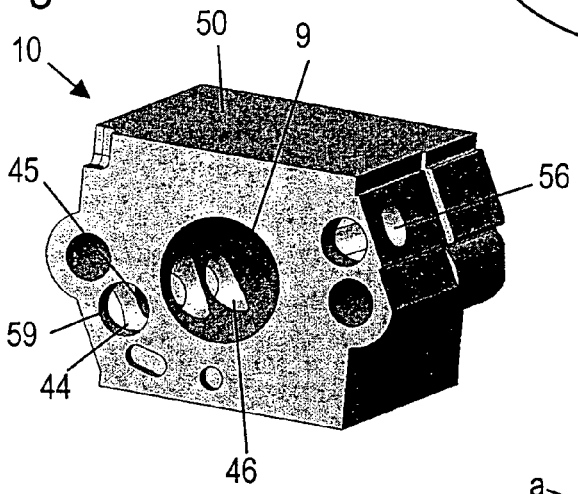
FIG. 6 is a perspective view showing the housing of a carburetor.

As FIG. 6 shows, the carburetor 10 has a carburetor housing 50 with a longitudinal bore in which the inlet channel 9 is guided. A transverse bore 56 runs transversely to the inlet channel 9 and has a significantly smaller diameter than the diameter of the inlet channel 9. A longitudinal bore 59 runs parallel to the inlet channel 9 and intersects the transverse bore 56. The longitudinal bore 59 defines an inlet opening 44 and an outlet opening 45 of the control valve 43. The outlet opening 45 is connected to the inlet channel 9 via a further transverse bore 46.

Figure 7:
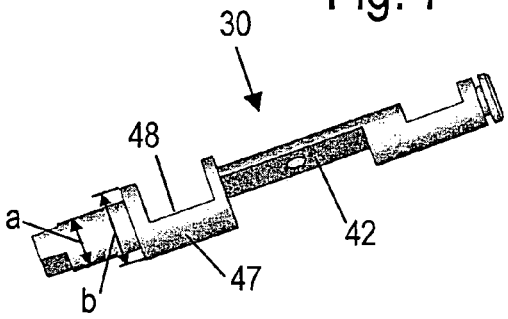
FIG. 7 shows the throttle shaft of a carburetor in side elevation.

In FIG. 7, the throttle shaft 30 is shown perspectively. The throttle shaft 30 has a cutout 42 for the throttle flap 29 in the section of the throttle shaft which is arranged in the inlet channel 9. The throttle flap 29 is fixedly secured with a threaded fastener in the cutout 42. A control section 47 is provided next to the cutout 42. The control section 47 has an enlarged diameter b which is greater than the diameter a of the throttle shaft 30 in the neighboring regions. In the control section 47, the throttle shaft 30 has a transverse slot 48 which controls the opening cross section of the control valve 43.

Figure 8:
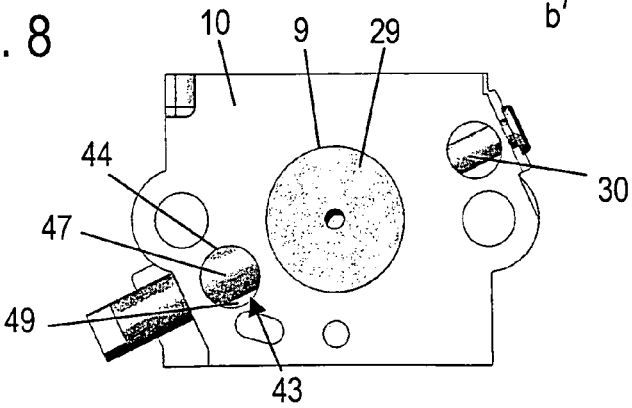
FIG. 8 is a side elevation view of a carburetor having a control valve.

In FIG. 8, the carburetor 10 is shown in a side elevation view. The throttle shaft 30 is arranged in the idle position in which the throttle flap 29 substantially closes the inlet channel 9. The control section 47 closes the flow connection between the inlet opening 44 and the transverse bore 46, which opens into the inlet channel 9, in this position of the throttle flap 30 up to a residual cross section 49. By rotating the throttle shaft 30 and pivoting the throttle flap 29, the transverse slot 48 is so rotated that the control section 47 is pivoted out of the region of the longitudinal bore 59. In the open position, the control valve 43 substantially clears the flow connection between the inlet channel 9 and the crankcase 4. The control valve 43 has a maximum opening cross section in this position.

Figure 9:
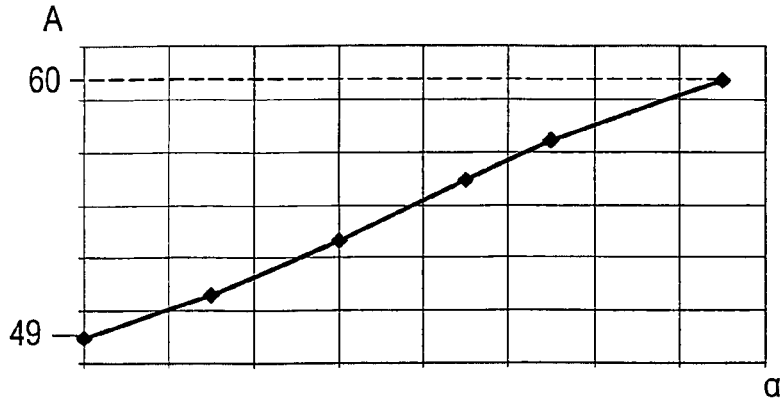
FIG. 9 is a diagram of the opening cross section of the control valve of FIG. 8 plotted as a function of throttle flap angle.

The course of the opening cross section A as a function of the throttle flap angle α is shown in FIG. 9. Even at a completely closed throttle flap 29, the control valve 43 clears a residual cross section 49. For a fully open throttle flap 29, the control valve 43 clears a maximum opening cross section 60. The course of the opening cross section between the residual cross section 49 and the maximum opening cross section 60 runs approximately linearly to the throttle flap angle α. The residual cross section 49 is preferably approximately 3% to 50% of the maximum opening cross section 60 of the control valve 43. Especially, the residual cross section 49 is 5% to 30% of the maximum opening cross section 60. This ratio of residual cross section to maximum cross section is also advantageous for other embodiments of a control valve.

Figure 10:
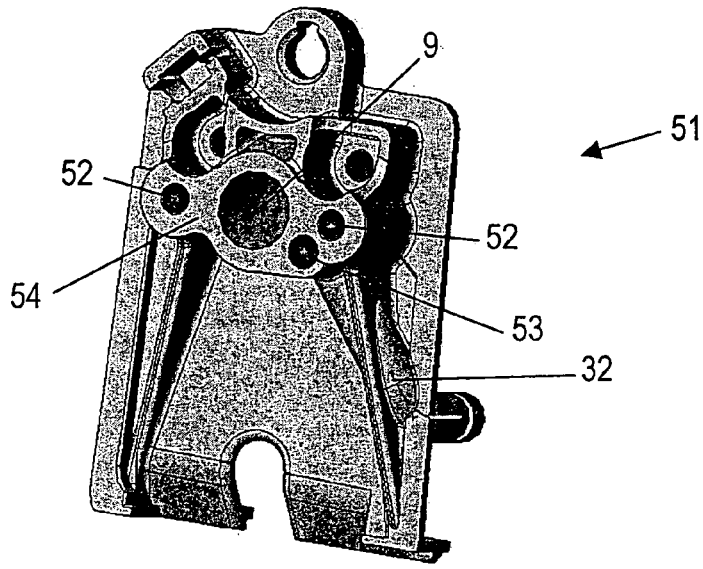
FIG. 10 is a perspective view of the connecting flange of an internal combustion engine.
Figure 11:
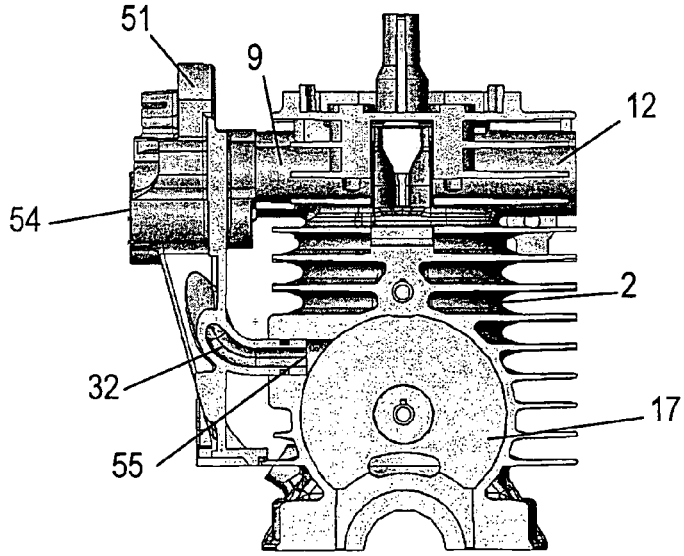
FIG. 11 is a schematic, partially in section, of the cylinder of an internal combustion engine having the connecting flange mounted thereon.

The constructive configuration of the connecting channel 32 is shown in FIGS. 10 and 11. The connecting channel 32 is configured at a connecting flange 51 which is fixed on the cylinder 2 of the engine. A section of the inlet channel 9 is configured in the connecting flange 51. The connecting flange 51 has two attachment bores 52 at respective sides of the inlet channel 9. On the side facing away from the cylinder 2, the connecting flange 51 has a connecting surface 54 whereat the carburetor 10 is mounted. The carburetor 10 is fixedly mounted on cylinder 2 via the attachment bores 52 with threaded fasteners. The connecting channel 32 opens with an opening 53 at the connecting surface 54. The opening 53 opens at the inlet opening 44 of the control valve 43 when the carburetor 10 is mounted at the connecting surface 54. As shown in FIG. 11, the connecting channel 32 opens via an opening 55 into the cam housing 17 of the internal combustion engine. The connecting channel 32 can, however, open also directly into the crankcase 4.

Figure 12:
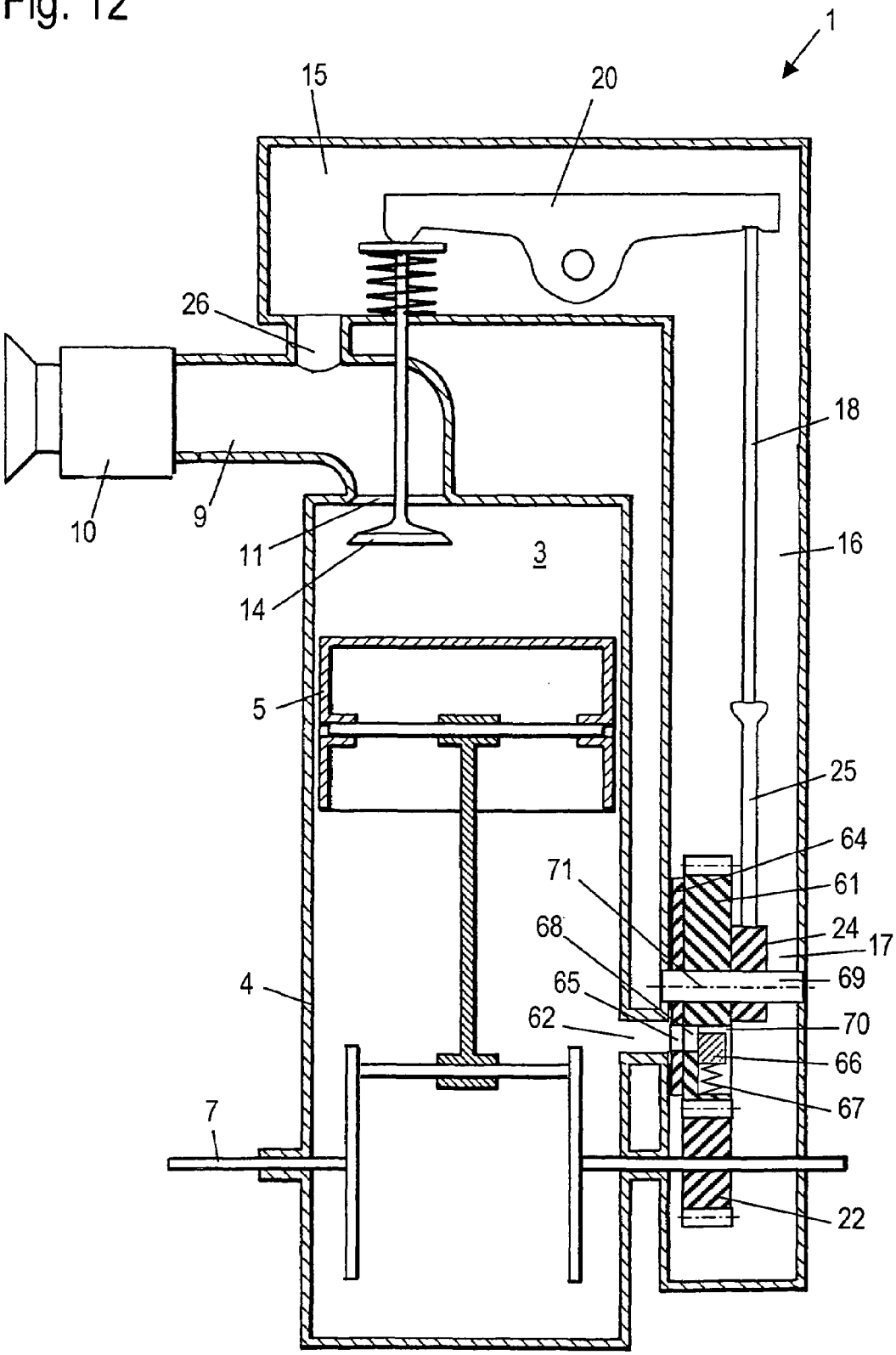
FIG. 12 is a schematic, in section, of an internal combustion engine.

A further embodiment of a control valve for the internal combustion engine 1 is shown in FIG. 12. The engine 1 corresponds essentially to the engine 1 shown in FIGS. 1 and 2. The same reference numerals identify the same elements. The crankcase 4 of the engine 1 is connected to the cam housing 17 via a connecting opening 62. In FIG. 12, the cam housing 17 is shown simplified as a housing with the channel 16 and the rocker lever housing 15. A cam wheel 61 is supported in the cam housing 17 on a support bolt 69 about a rotational axis 71. The cam wheel 61 is driven by the pinion 22. Next to the cam wheel 61, a bearing disc 64 is mounted which lies on the wall of the cam housing 17. The bearing disc 64 is mounted in the cam housing 17 so as to rotate therewith and has an opening 65 at which the connecting opening 62 opens. The cam wheel 61 has an opening 68 which is arranged at the same distance to the rotational axis 71 as the openings 62 and 65 so that the opening 68 comes into coincidence with the openings 62 and 65 in pregiven rotational positions of the cam wheel 61.

The cam wheel 61 has a cutout 70 in which a centrifugal weight 66 is mounted. Referred to the rotational axis 71, the centrifugal weight 66 is spring supported outwardly by a spring 67. The spring 67 thereby acts to counter the centrifugal force on the centrifugal weight 66. The centrifugal weight 66 is mounted in the cam wheel 61 in the region of the opening 68.

Figure 13:
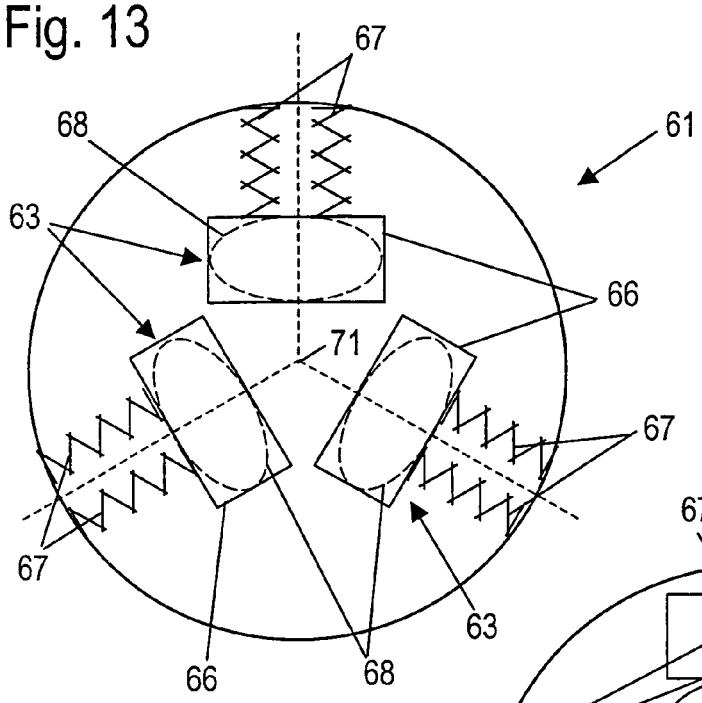
FIGS. 13 and 14 are schematics showing the control valve of the internal combustion engine of FIG. 12 with the valve in two different positions; and, FIG. 15 is a curve showing the opening cross section of the control valve of FIGS. 13 and 14 plotted as a function of the rpm.
Figure 14:
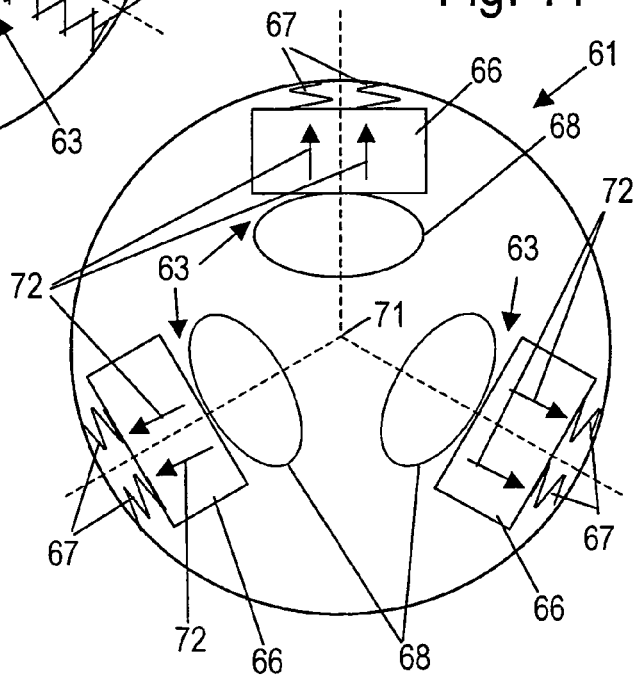

The cam wheel 61 is shown schematically in FIGS. 13 and 14. In FIG. 13, the cam wheel 61 is shown in the rest position. Three centrifugal weights 66 are provided which are each spring supported with two springs respectively radially to the outside referred to the rotational axis 71. In the rest position or at low rpms, the centrifugal weights 66 are mounted in front of the three openings 68 in the cam wheel 61. The centrifugal weights 66 with the openings 68 define control valves 63 which are controlled in dependence upon rpm. In FIG. 13, the control valves 63 are shown completely closed so that the flow connection between inlet channel 9 and crankcase 4 is interrupted. A stop can, however, be provided against which the springs 67 press the centrifugal weights 66 so that a residual cross section of the openings 68 remains open. As soon as the cam wheel 61 rotates, the centrifugal force acts on the centrifugal weights 66. Referred to the rotational axis 71, the centrifugal weights 66 are pressed radially outwardly against the force of the spring 67. This is indicated in FIG. 14 by the arrows 72. In FIG. 14, the control valves 63 are shown in the maximum open position. The centrifugal weights 66 are mounted radially outside of the openings 68 and do not close the same.

Figure 15:
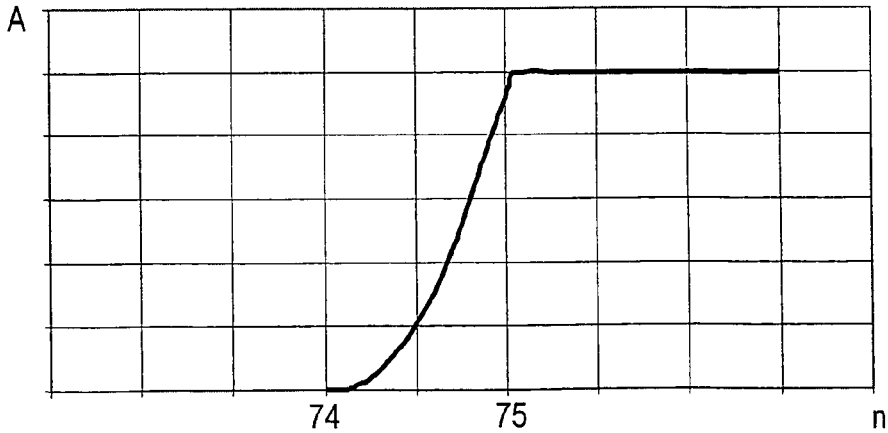

In FIG. 15, the opening cross section A is shown plotted as a function of rpm (n) for the control valves 63. Up to a pregiven rpm 74, the control valves 63 remain completely closed. The centrifugal force, which acts on the centrifugal weights 66, is less than the force of the springs 67. When the rpm 74 is exceeded, the centrifugal weights 66 are pressed increasingly outwardly so that the opening cross section is increased up to reaching the rpm 75. By adapting the form of the openings 68, the characteristic of the curve can be changed. When reaching the rpm 75, the centrifugal weights 66 are arranged fully outside of the openings 68 so that even with a further increase of rpm, no change of the cross-sectional opening A results.

In the FIGS., the inlet channel 9 is connected in each case via a single flow connection to the crankcase 4. However, a control valve can also be provided in an internal combustion engine for which two flow connections are provided between the inlet channel and the crankcase. Here, a flow connection from the inlet channel to the crankcase and a second flow connection from the crankcase to the inlet channel are provided. In order to ensure the direction of the flow, a check valve can be provided.

It is understood that the foregoing description is that of the preferred embodiments of the invention and that various changes and modifications may be made thereto without departing from the spirit and scope of the invention as defined in the appended claims.

What is claimed is:

1. A mixture-lubricated internal combustion engine comprising:

a cylinder defining a combustion chamber;

a piston disposed in said cylinder so as to move back and forth therein and to delimit said combustion chamber;

a crankcase connected to said cylinder;

a crankshaft rotatably journalled in said crankcase and driven by said piston;

said cylinder having an intake inlet communicating with said combustion chamber;

an inlet channel for supplying fuel and combustion air to said intake inlet;

said cylinder having an exhaust outlet through which exhaust gases pass from said combustion chamber;

a valve system for controlling the opening and closing of said intake inlet and said exhaust outlet;

a flow connection between said crankcase and said inlet channel for facilitating a lubrication of said crankcase as a consequence of pressure pulsations in said inlet channel and said crankcase;

a control valve disposed in said flow connection between said crankcase and said inlet channel;

said control valve being movable between first and second positions which are independent of an angular position of said crankshaft; and, said control valve substantially closing said flow connection in said first position when said engine is in idle and said control valve having a maximum open cross section in said second position when said engine is at full-load operation.

2. The internal combustion engine of claim 1, wherein said control valve includes a control valve member movable between said first position wherein said flow connection is closed down to a residual cross section and said second position wherein a maximum opening cross section is provided in said flow connection.

3. The internal combustion engine of claim 2, wherein said residual cross section is approximately 3% to 50% of said maximum opening cross section.

4. The internal combustion engine of claim 3, wherein said control valve is controlled in dependence upon the engine load.

5. The internal combustion engine of claim 4, further comprising a throttle flap arranged in said inlet channel and a throttle shaft for controlling the position of said throttle flap.

6. The internal combustion engine of claim 5, wherein said control valve is formed on said throttle shaft.

7. The internal combustion engine of claim 6, wherein said throttle shaft has a control section having a transverse slot which defines said control valve.

8. The internal combustion engine of claim 4, wherein said control valve is substantially closed at low engine load and open at high engine load.

9. The internal combustion engine of claim 2, wherein said residual cross section is approximately 5% to 30% of said maximum opening cross section.

10. The internal combustion engine of claim 1, wherein said control valve is actuated in dependence upon engine rpm (n).

11. The internal combustion engine of claim 10, further comprising at least one centrifugal weight; and, an opening controlled by said centrifugal weight and defining said control valve.

12. The internal combustion engine of claim 11, further comprising a base body rotatably driven by said crankshaft; said centrifugal weight being supported in said base body; and, said opening being formed in said base body.

13. The internal combustion engine of claim 12, wherein said base body is a cam wheel driven by said crankshaft.

14. The internal combustion engine of claim 1, wherein said control valve is actuated in dependence upon underpressure present in said crankcase.

15. The internal combustion engine of claim 14, wherein said control valve includes a control opening communicating with said flow connection and a control piston controlling said control opening; and, said control piston having a first end charged by the pressure in said crankcase and a second end charged by ambient pressure.

16. The internal combustion engine of claim 15, said control valve further including a spring mounted at said first end of said control piston for pressing said control piston in the direction of said second end subjected to said ambient pressure.

17. The internal combustion engine of claim 1, wherein said flow connection is the only flow connection between said crankcase and said inlet channel.

* * * * *